US011655733B2

(12) United States Patent
Terada et al.

(10) Patent No.: US 11,655,733 B2
(45) Date of Patent: May 23, 2023

(54) TURBINE STATOR, STEAM TURBINE, AND PARTITION PLATE

(71) Applicant: MITSUBISHI HEAVY INDUSTRIES COMPRESSOR CORPORATION, Tokyo (JP)

(72) Inventors: Katsumi Terada, Hiroshima (JP); Yuzo Tsurusaki, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 17/274,681

(22) PCT Filed: Sep. 27, 2019

(86) PCT No.: PCT/JP2019/038344
§ 371 (c)(1),
(2) Date: Mar. 9, 2021

(87) PCT Pub. No.: WO2020/067496
PCT Pub. Date: Apr. 2, 2020

(65) Prior Publication Data

US 2022/0049627 A1 Feb. 17, 2022

(30) Foreign Application Priority Data

Sep. 28, 2018 (JP) ..... JP2018-183138

(51) Int. Cl.
*F01D 25/24* (2006.01)
*F01D 9/04* (2006.01)
*F01D 11/02* (2006.01)

(52) U.S. Cl.
CPC ..... *F01D 25/246* (2013.01); *F01D 9/047* (2013.01); *F01D 9/048* (2013.01); *F01D 11/02* (2013.01);

(Continued)

(58) Field of Classification Search
CPC ..... F01D 25/246; F01D 25/243; F01D 9/047; F01D 9/048; F01D 11/02; F01D 5/142;

(Continued)

(56) References Cited

U.S. PATENT DOCUMENTS 2,197,521 A * 4/1940 Egli ..... F01D 9/047 415/199.5
7,287,956 B2 * 10/2007 Bracken ..... F01D 11/122 415/230

(Continued)

FOREIGN PATENT DOCUMENTS

CN 103375180 A 10/2013
EP 2657454 A1 10/2013

(Continued)

OTHER PUBLICATIONS

International Search Report in corresponding International Application No. PCT/JP2019/038344, dated Dec. 17, 2019 (4 pages).

(Continued)

*Primary Examiner* — Eldon T Brockman
*Assistant Examiner* — Maxime M Adjagbe
(74) *Attorney, Agent, or Firm* — Osha Bergman Watanabe & Burton LLP

(57) ABSTRACT

A turbine stator includes a partition plate including an inner ring that extends along a circumferential direction, an outer ring that is disposed on an outer side of the inner ring in a radial direction, and extends in the circumferential direction, a plurality of nozzles that are disposed in the circumferential direction between the inner ring and the outer ring, and are configured to guide a fluid from an upstream side toward a downstream side in an axial direction, and an annular protruding portion, protrudes from the outer ring to the downstream side in the axial direction, and extends along the outer ring in the circumferential direction, and a casing (Continued)

surrounding the partition plate from the outer side in the radial direction, and having a contact support surface that is in contact with the annular protruding portion from the downstream side in the axial direction.

5 Claims, 4 Drawing Sheets

(52) U.S. Cl.
CPC .... *F05D 2220/31* (2013.01); *F05D 2240/128* (2013.01); *F05D 2240/14* (2013.01)

(58) Field of Classification Search
CPC ..... F05D 2220/14; F05D 2220/34; F05D 2240/18
See application file for complete search history.

(56) References Cited

U.S. PATENT DOCUMENTS

| | | | | |
|---|---|---|---|---|
| 8,105,023 | B2 * | 1/2012 | Ikeda | F01D 11/001 415/173.1 |
| 2004/0253095 | A1 | 12/2004 | Sasaki et al. | |
| 2004/0253100 | A1 | 12/2004 | Blatchford et al. | |
| 2008/0193283 | A1 | 8/2008 | Burdgick et al. | |
| 2012/0219412 | A1 | 8/2012 | Nakayama et al. | |
| 2013/0223998 | A1 * | 8/2013 | Endo | F01D 11/001 415/174.5 |
| 2013/0287563 | A1 * | 10/2013 | Brummitt-Brown | F01D 9/042 415/209.4 |
| 2016/0169023 | A1 * | 6/2016 | Mizumi | F16J 15/447 277/416 |
| 2017/0096904 | A1 * | 4/2017 | Joshi | F01D 9/042 |
| 2017/0284209 | A1 * | 10/2017 | Yamamoto | F01D 5/141 |
| 2017/0350264 | A1 * | 12/2017 | Terada | F16J 15/445 |

FOREIGN PATENT DOCUMENTS

| | | | |
|---|---|---|---|
| EP | 2778375 | A2 | 9/2014 |
| JP | H10-331604 | A | 12/1998 |
| JP | 2003-097218 | A | 4/2003 |
| JP | 2013-227980 | A | 11/2013 |
| JP | 2017-057831 | A | 3/2017 |
| JP | 2017-115803 | A | 6/2017 |
| JP | 2017-150386 | A | 8/2017 |

OTHER PUBLICATIONS

Written Opinion in corresponding International Application No. PCT/JP2019/038344, dated Dec. 17, 2019 (11 pages).

* cited by examiner

TURBINE STATOR, STEAM TURBINE, AND PARTITION PLATE

TECHNICAL FIELD

The present invention relates to a turbine stator, a steam turbine, and a partition plate.

Priority is claimed on Japanese Patent Application No. 2018-183138, filed Sep. 28, 2018, the content of which is incorporated herein by reference.

BACKGROUND ART

A steam turbine includes a rotor that rotates centered on an axis and a casing that covers the rotor. The rotor has a rotor shaft extending in an axial direction centered on the axis, and a plurality of rotor blades disposed around the rotor shaft. In a casing, a partition plate having a plurality of nozzles (stator blades) disposed around the rotor is fixed to an upstream side of each rotor blade.

Patent Literature 1 discloses a nozzle diaphragm (partition plate) in which a nozzle diaphragm outer ring (outer ring) is provided on an outer side of the nozzle in a radial direction, and a nozzle diaphragm inner ring (inner ring) is provided on an inner side of the nozzle. The nozzle diagram is formed in an annular shape by vertically combining semi-annular members. Such a nozzle diaphragm accommodates the turbine rotor inside in a rotatable state. A plurality of nozzle diaphragms are arranged in the casing.

CITATION LIST

Patent Literature

Patent Literature 1

Japanese Unexamined Patent Application, First Publication No. 2017-150386

SUMMARY OF INVENTION

Technical Problem

By the way, in the steam turbine, the steam flowing inside causes a pressure difference between an upstream side and a downstream side of the partition plate in the axial direction. Due to the pressure difference, a load is generated on the partition plate so that the inner side in the radial direction bends toward the downstream side in the axial direction. In order to suppress the deformation of the partition plate due to such a load, the strength of the partition plate is maintained by ensuring a constant thickness in the axial direction. On the other hand, in a case where the partition plate is thick, there is a concern that the size of the steam turbine will increase significantly as the number of stages increases. Therefore, it is desired that deformation of the partition plate is suppressed while reducing the thickness in the axial direction.

The present invention provides a turbine stator, a steam turbine, and a partition plate capable of suppressing deformation while reducing the thickness in the axial direction.

Solution to Problem

A turbine stator according to a first aspect of the present invention includes a partition plate including an inner ring that extends along a circumferential direction around an axis, an outer ring that is disposed on an outer side with respect to the inner ring in a radial direction with respect to the axis, and extends in the circumferential direction, a plurality of nozzles that are disposed between the inner ring and the outer ring in the circumferential direction, and are configured to guide a fluid from an upstream side toward a downstream side in an axial direction in which the axis extends, and an annular protruding portion, protrudes from the outer ring to the downstream side in the axial direction, and extends along the outer ring in the circumferential direction, and a casing surrounding the partition plate front the outer side in the radial direction, and having a contact support surface that is in contact with the annular protruding portion from the downstream side in the axial direction.

According to such a configuration, by the annular protruding portion and protrudes from the outer ring, the partition plate has a shape in which a region on the outer side in the radial direction protrudes to the downstream side so as to have an arch shape when viewed front the radial direction. Further, the partition plate is supported by the casing in a state where the annular protruding portion is in contact with the contact support surface. As a result, a compressive force acts on a region of the partition plate on the inner side in the radial direction. Even in a case where a load is generated by the differential pressure between the upstream side and the downstream side of the partition plate, the compressive force resists the load, so that in the partition plate, deformation such that the region on the inner side in the radial direction is directed to the downstream side, in the axial direction is suppressed. In this way, the rigidity of the partition plate with respect to the differential pressure can be ensured without increasing the thickness of the region on the inner side in the radial direction.

In the turbine stator according to a second aspect of the present invention, the annular protruding portion may protrude to the outer side in the radial direction from an outer circumferential surface of the outer ring facing the outer side in the radial direction.

According to such a configuration, the annular protruding portion the partition plate contacts with the casing earlier than the outer ring and serves as a guide for the casing. As a result, the position of the annular protruding portion with respect to the casing can be determined with high accuracy. Accordingly, the annular protruding portion can be reliably brought into contact with the contact support surface, and the deformation of the partition plate can be suppressed with higher accuracy.

In the turbine stator according to a third aspect of the present invention, the annular protruding portion may have a tapered surface formed at a corner that is formed by a protruding portion outer circumferential surface facing the outer side in the radial direction and a protruding portion upstream surface facing the upstream side in the axial direction.

According to such a configuration, in a case where the upper half casing is assembled to the partition plate, it is possible to prevent the inner circumferential surface of the casing from being placed on the corner and making it difficult for the annular protruding portion to fit. As a result, it is possible to suppress the assemblability from being deteriorated such that the partition plate and the casing do not fit.

In the turbine stator according to a fourth aspect of the present invention, the partition plate may include an upper half partition plate having a semi-annular shape, and upper half partition plate dividing surfaces, which are horizontal surfaces facing a lower side in a vertical direction, at both ends in the circumferential direction, a lower half partition plate having a semi-annular shape, and lower half partition plate dividing surfaces, which are configured to contact with the upper half partition plate dividing surfaces, at both ends in the circumferential direction, and a fixing unit fixing the upper half partition plate and the lower half partition plate to be immovable at a position closer to the nozzle than at least one of the outer circumferential surface of the outer ring and the outer circumferential surface of the annular protruding portion in the radial direction.

According to such a configuration, it is possible to improve the assemblability of the partition plate by having the vertically divided structure. Further, the upper half partition plate and the lower half partition plate are fixed at the position closer to the nozzle than at least one of the outer circumferential surface of the outer ring or the outer circumferential surface of the annular protruding portion in the radial direction. As a result, in a case where a load is generated on the partition plate, it is possible to make it difficult to open the region on the inner side in the radial direction, which is particularly easy to open, of the upper half partition plate dividing surface and the lower half partition plate dividing surface. Accordingly, the amount of deformation of the partition plate can be suppressed.

In the turbine stator according to a fifth aspect of the present invention, a fin may be disposed on a surface of the annular protruding portion, which faces an inner side in the radial direction.

According to such a configuration, the annular protruding portion itself can serve as a flow guide.

A steam turbine according to a sixth aspect of the present invention includes the turbine stator, and a rotor that is configured to rotate around the axis in the turbine stator.

According to such a configuration, the thickness of the partition plate is reduced, so that the size can be reduced. Further, even in a case where the number of stages is increased to improve efficiency, the increase in size can be suppressed.

A partition plate according to a seventh aspect of the present invention includes an inner ring that extends along a circumferential direction around an axis, an outer ring that is disposed on an outer side with respect to the inner ring in a radial direction with respect to the axis, and extends in the circumferential direction, a plurality of nozzles that are disposed between the inner ring and the outer ring in the circumferential direction, and are configured to guide a fluid from an upstream side toward a downstream side in an axial direction in which the axis extends, and a annular protruding portion, protrudes from the cuter ring to the downstream side in the axial direction, and extends along the outer ring in the circumferential direction, in which the annular protruding portion protrudes to the outer side in the radial direction from an outer circumferential surface of the outer ring facing the outer side in the radial direction.

Advantageous Effects of Invention

According to the present invention, it is possible to suppress deformation while reducing the thickness in the axial direction.

DESCRIPTION OF EMBODIMENTS

Hereinafter, a strain turbine according to an embodiment of the present invention will be described in detail with reference to the drawings.

Figure 1:
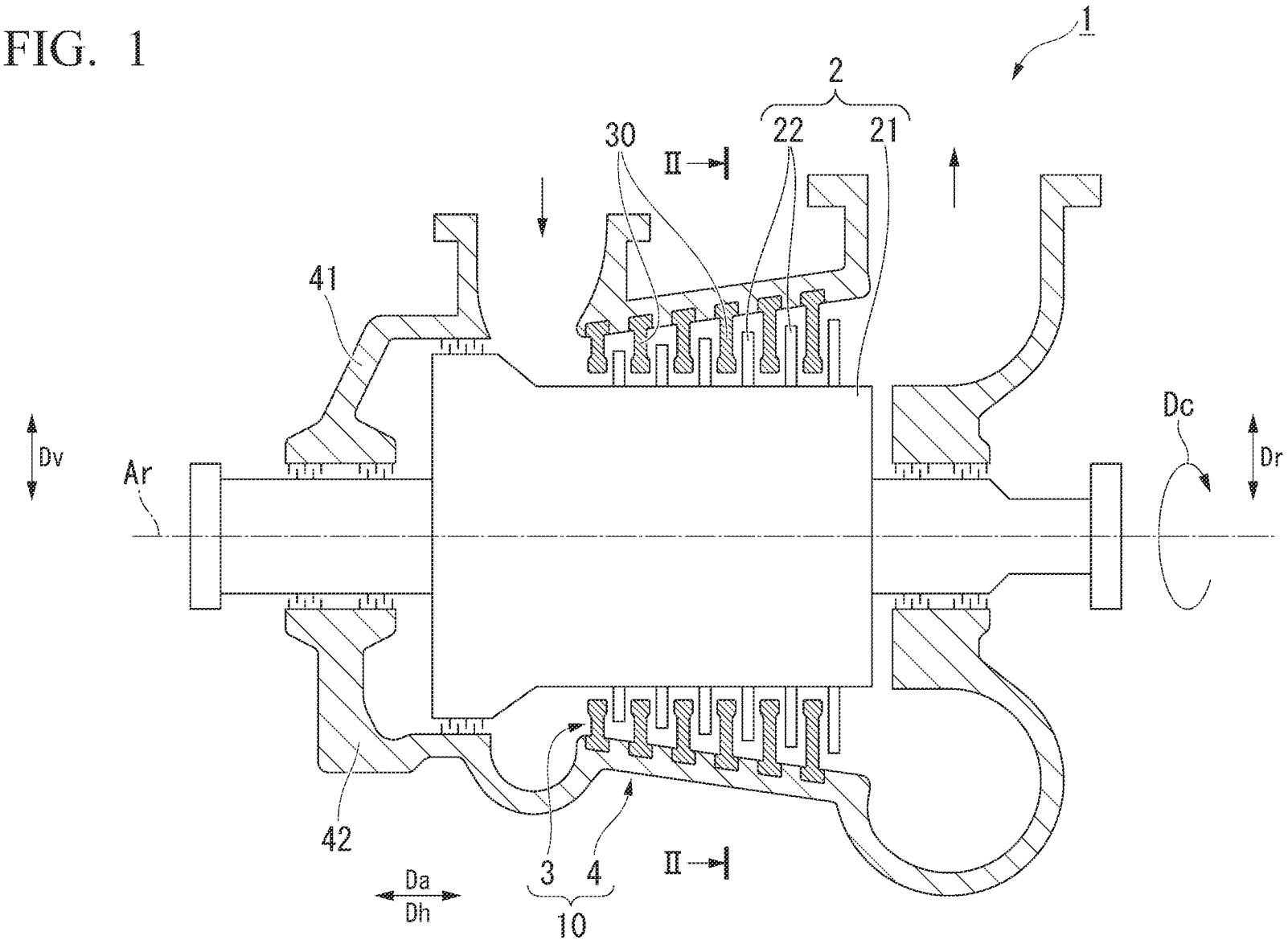
FIG. 1 is a cross-sectional view of a steam turbine according to an embodiment of the resent invention.

As shown in FIG. 1, the steam turbine 1 includes a rotor 2 and a turbine stator 10.

The rotor 2 is rotatable around an axis Ar. The rotor 2 has a rotor shaft 21 extending in an axial direction Da around the axis Ar, and a plurality of rotor blades 22 fixed to the rotor shaft 21 along a circumferential direction Dc with respect to the rotor shaft 21.

Figure 4:
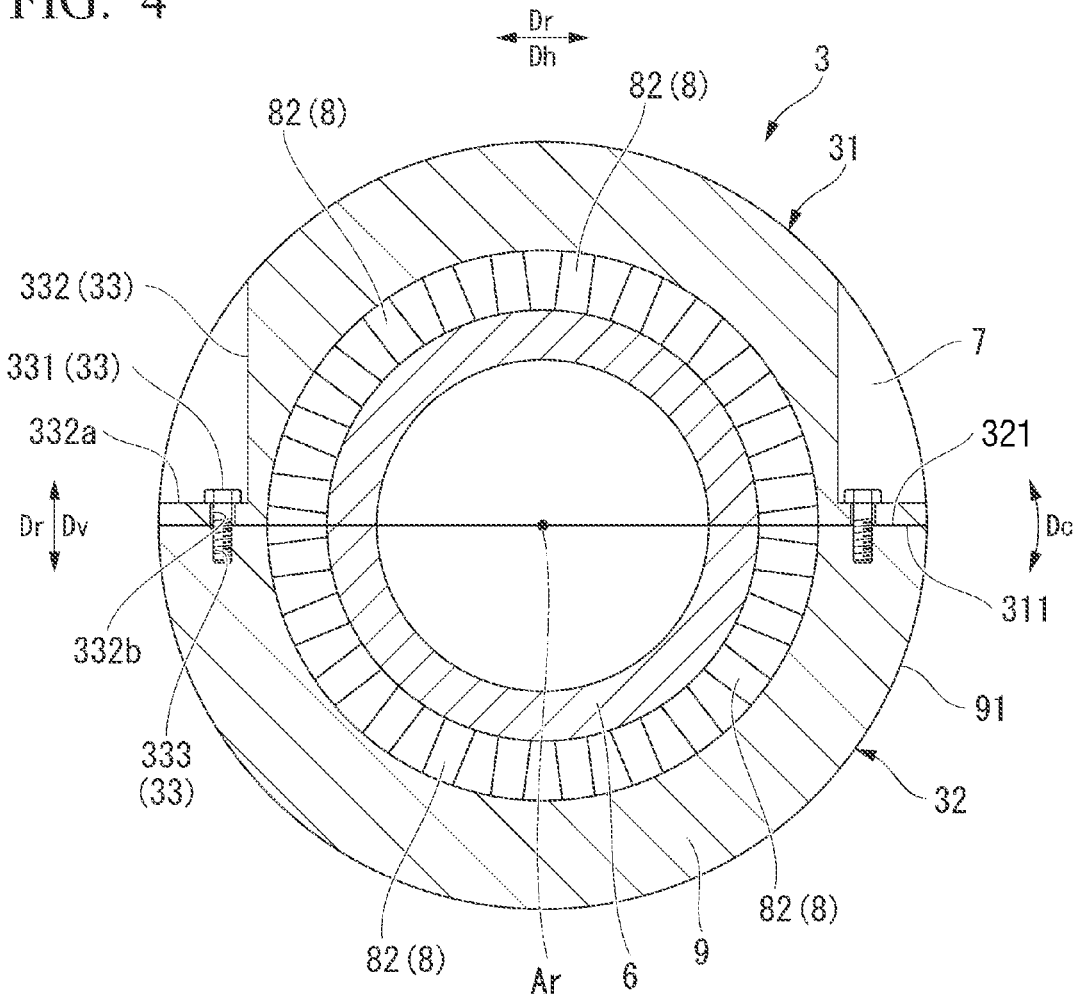
FIG. 4 is a schematic view of the partition plate according to present embodiment as viewed from the axial direction.

In the following, the direction in which the axis Ar extends is referred to as the axial direction Da. The radial direction with respect to the axis Ar as a reference is simply referred to as a radial direction Dr. In the radial direction Dr, the vertical direction of the paper surface in FIG. 1 is defined as a vertical direction Dv. Further, the right and left direction of FIG. 1 and the right and left direction of FIG. 4 are defined as a horizontal direction Dh orthogonal to the vertical direction Dv. Further, the direction around the rotor 2 centered on the axis Ar is defined as the circumferential direction Dc.

The turbine stator 10 accommodates the rotor 2 inside in a state of being rotatable centered on the axis Ar. The turbine stator 10 has a partition plate 3 and a casing 4.

The partition plate 3 is disposed on the outer circumferential side of the rotor 2. The partition plate 3 has an annular shape centered on the axis Ar. The partition plate 3 that has an annular shape has a plurality of nozzles (stator blades) 8 arranged in the circumferential direction Dc at a position near the middle of the partition plate 3 in the radial direction Dr and on the upstream side in the axial direction Da from the rotor blade 22 of the rotor 2. In the steam turbine 1, a cylindrical space on the outer circumferential side of the rotor shaft 21 and near the middle of the partition plate 3 that has an annular shape, that is, the space where the rotor blade 22 and a nozzle 8 are disposed is a steam flow path through which steam of working fluid flows. The details of the shape of the partition plate 3 will be described below.

The casing 4 is disposed on the outer circumferential side of the partition plate 3. The casing 4 has a cylindrical shape centered on the axis Ar. The casing 4 surrounds the partition plate 3 from the outer side in the radial direction Dr. The casing 4 that has a cylindrical shape includes an upper half casing 41 on the upper portion and a lower half casing 42 on the lower portion with the axis Ar of the rotor 2 as a reference.

The upper half casing 41 extends in the circumferential direction Dc. The cross section of the upper half casing 41 orthogonal to the axis Ar forms a semi-annular shape centered on the axis Ar. The upper half casing 41 opens to face a lower side in the vertical direction Dv so as to be capable of accommodating the rotor 2 and the partition plate 3.

The lower half casing 42 extends in the circumferential direction Dc. The cross section of the lower half casing 42 orthogonal to the axis Ar forms a semi-annular shape centered on the axis Ar. An inner diameter of the lower half casing 42 is formed to be the same as an inner diameter of the upper half casing 41. The lower half casing 42 opens to face the upper side in the vertical direction Dv so as to be capable of accommodating the rotor 2 and the partition plate 3. The upper half casing 41 is placed on the lower half casing 42 on the upper side in the vertical direction Dv and is fixed by a fastening member such as a bolt 331 (not shown) in a state where the dividing surfaces are in contact with each other. As a result, the casing 4 is formed.

Figure 2:
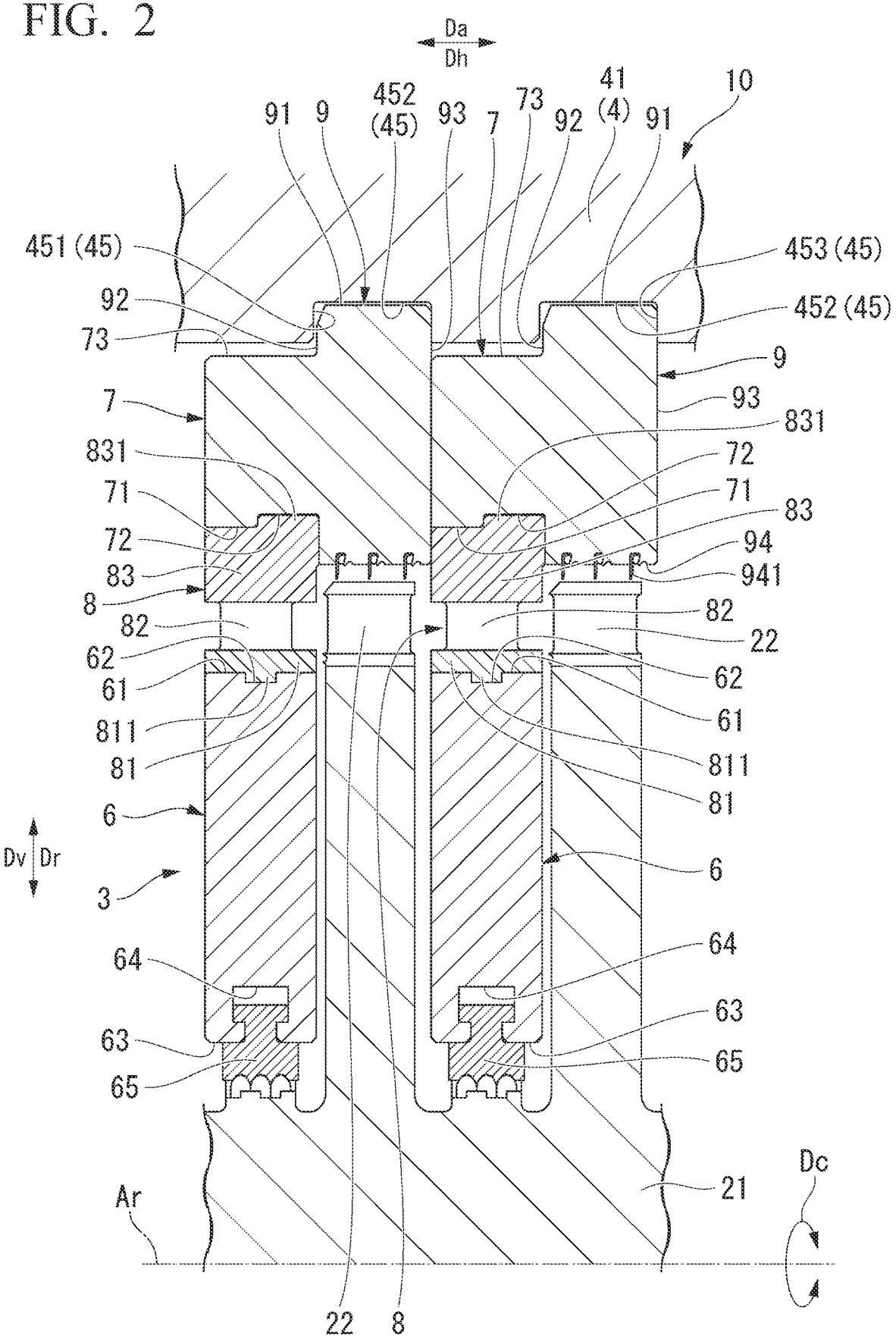
FIG. 2 is a cross-sectional view showing a cross section of a main part inside the steam turbine according to the present embodiment.
Figure 3:
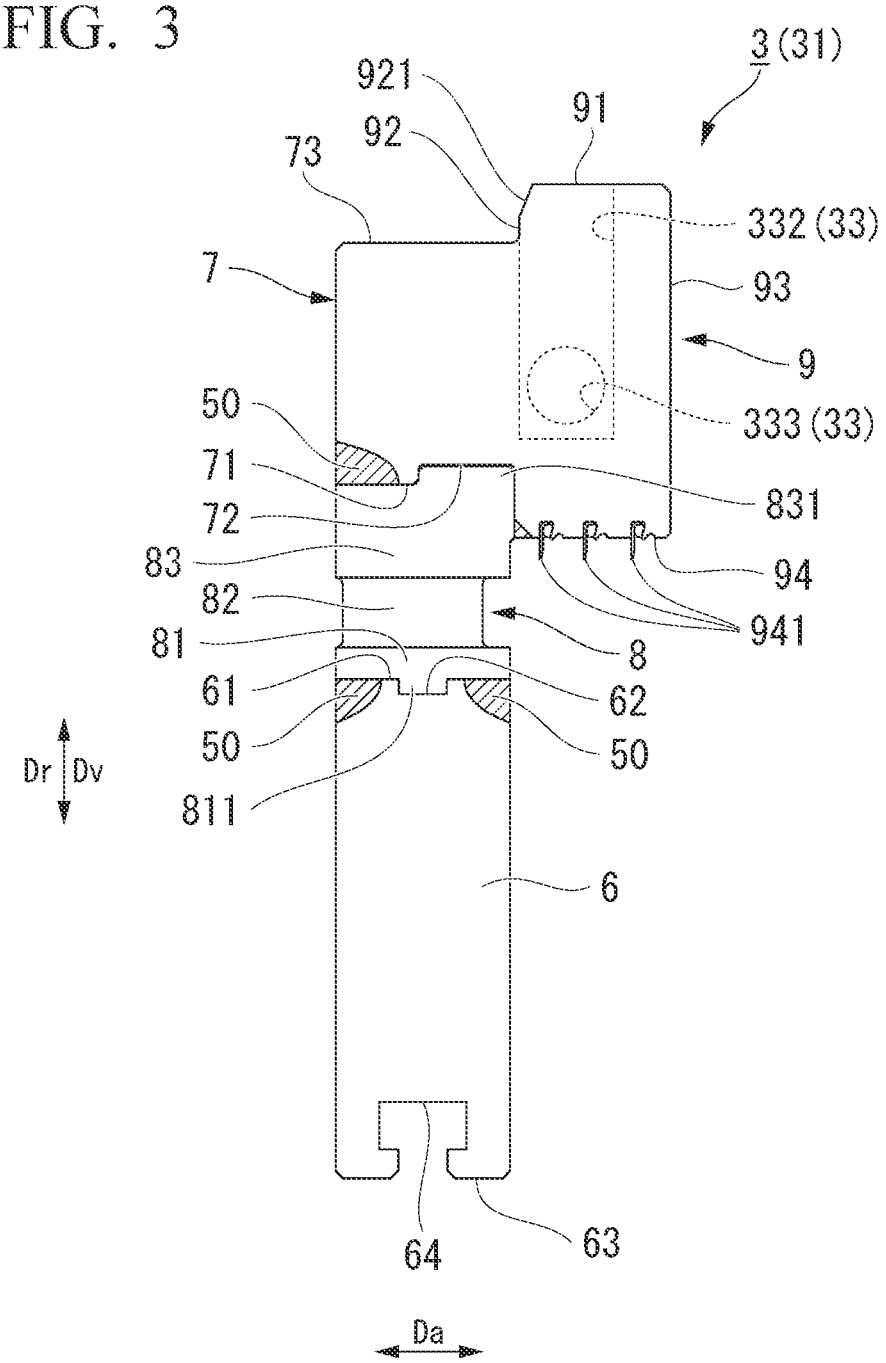
FIG. 3 is a cross-sectional view showing a cross section of a main part inside a partition plate according to the present embodiment.

As shown in FIGS. 2 to 4, the partition plate 3 has an inner ring 6, an outer ring 7, the nozzle 8, and an annular protruding portion 9. The inner ring 6, the outer ring 7, the nozzle 8, and the annular protruding portion 9 are integrally formed or welded and joined to form a single member.

The inner ring extends in the circumferential direction Dc around axis Ar. The nozzle 8 is fixed to an inner ring outer circumferential surface 61, which is a surface (outer circumferential surface) of the inner ring 6 facing the outer side in the radial direction Dr. Specifically, an inner ring nozzle fixing groove 62 into which part of the nozzle 8 is fitted is formed on the inner ring outer circumferential surface 61. The inner ring nozzle fixing groove 62 is a groove formed so as to be recessed to the inner side in the radial direction Dr from the inner ring outer circumferential surface 61. On the other hand, a seal support groove 64 supports a labyrinth seal 65 is formed on an inner ring inner circumferential surface 63, which is a surface (inner circumferential surface) of the inner ring 6 facing the inner side of the radial direction Dr. The seal support groove 64 is a groove formed so as to be recessed to the outer side in the radial direction Dr from the inner ring inner circumferential surface 63. That is, the seal support groove 64 opens to the inner side in the radial direction Dr. The labyrinth seal 65 is a seal member made of, for example, an alloy containing copper. The labyrinth seal 65 seals between the rotor shaft 21 and the outer circumferential surface.

The outer 7 is provided on the outer side of the inner ring 6 in the radial direction Dr such than the nozzle 8 is interposed. The outer ring 7 extends in the circumferential direction Dc centered on the axis Ar. The nozzle 8 is fixed to an outer ring inner circumferential surface 71, which is a surface (inner circumferential surface) of the outer ring 7 facing the inner side in the radial direction Dr. Specifically, an outer ring nozzle fixing groove 72 into which part of the nozzle 8 is fitted is formed on the outer ring inner circumferential surface 71. The outer ring nozzle fixing groove 72 is a groove formed so as to be recessed to the outer side in the radial direction Dr from the outer ring inner circumferential surface 71.

The nozzle 8 is capable of guiding the fluid toward the rotor blade 22 from the upstream side to the downstream side in the axial direction Da. A plurality of the nozzles 8 are provided in the circumferential direction Dc in a state of being interposed between the inner ring and the outer ring 7 in the radial direction Dr. The nozzle 8 according to the present embodiment has an inner shroud ring 81, a blade 82, and an outer shroud ring 83.

As shown in FIG. 2, the inner shroud ring 81 fixes the blade 82 to the inner ring 6. An inner protrusion 811 that fits into the inner ring nozzle fixing groove 62 is formed on the surface (inner circumferential surface) of the inner shroud ring 81 facing the inner side in the radial direction Dr. As shown in FIG. 3, in a state where the inner protrusion 811 is fitted into the inner ring nozzle fixing groove 62, a welding portion 50 is formed by performing welding between the inner shroud ring 81 and the inner ring 6 and is integrally joined.

As shown in FIG. 2, the outer shroud ring 83 fixes the blade 82 to the outer ring 7. The surface (inner circumferential surface) of the outer shroud ring 83 facing the inner side in the radial direction Dr is integrated with an end portion of the blade 82 on the outer side in the radial direction Dr. An outer protrusion 831 that fits into the outer ring nozzle fixing groove 72 is formed on the surface (outer circumferential surface) of the outer shroud ring 83 facing the outer side in the radial direction Dr. As shown in FIG. 3, in a state where the outer protrusion 831 is fitted into the outer ring nozzle fixing groove 72, the welding portion 50 is formed by performing welding between the outer shroud ring 83 and the outer ring 7, and is integrally joined.

As shown in FIG. 2, the blade 82 extends between the inner shroud ring 81 and the outer shroud ring 83 in the radial direction Dr. The blade 8 is a member having a wing shape in cross-sectional shape as viewed from the radial direction Dr. The blade and the rotor blade 22 overlap each other as viewed from the axial direction Da. As shown FIG. 4, a plurality of the blades 82 are disposed at intervals in the circumferential direction Dc.

The annular protruding portion 9 extends in the circumferential direction Dc along the outer ring 7. As shown in FIG. 2, the annular protruding portion 9 protrudes from the outer ring 7 to the downstream side in the axial direction Da such that the position of the axial direction Da overlap the rotor blade 22 disposed on the downstream side of the nozzle 8 in a state where the partition plate 3 is accommodated in the casing 4. The annular protruding portion 9 is formed as an integral part with the outer ring 7. The annular protruding portion 9 according to the present embodiment protrudes to the outer side in the radial direction Dr from the outer ring outer circumferential surface 73 of the outer ring 7 in addition to the downstream side in the axial direction Da. The outer ring outer circumferential surface 73 is the surface (outer circumferential surface) of the outer ring 7 facing the outer side in the radial direction Dr. Further, the annular protruding portion 9 also protrudes to the inner side in the radial direction Dr from the outer ring inner circumferential surface 71. The annular protruding portion 9 protrudes to the position where the inner position in the radial direction Dr overlaps the outer shroud ring 83 and does not overlap the blade 82 as viewed from the axial direction Da. Therefore, the annular protruding portion 9 is formed in a size that covers the outer ring 7 as viewed from the downstream side in the axial direction Da. The annular protruding portion 9 has a protruding portion outer circumferential surface 91, a protruding portion upstream surface 92, a protruding portion downstream surface 93, and a protruding portion inner circumferential surface 94.

The protruding portion outer circumferential surface 91 is a curved surface of the annular protruding portion 9 facing the outer side in the radial direction Dr. The protruding portion outer circumferential surface 91 is formed on the outer side in the radial direction Dr from the outer ring outer circumferential surface 73.

The protruding portion upstream surface 92 is a plane facing the upstream side in the axial direction Da on the outer side in the radial direction Dr from the outer ring outer circumferential surface 73. The protruding portion upstream surface 92 is formed the upstream side of the protruding portion outer circumferential surface 91 in the axial direction Da. In the present embodiment, a tapered surface 921 is formed on a corner formed by the protruding portion outer circumferential surface 91 and the protruding portion upstream surface 92. The tapered surface 921 is inclined so as to face the upstream side in the axial direction Da and the outer side in the radial direction Dr.

The protruding portion downstream surface 93 is a plane of the annular protruding portion 9 facing the downstream side in the axial direction Da. The protruding portion downstream surface 93 is connected to an end portion of the protruding portion outer circumferential surface 91 on the downstream side in the axial direction Da. The protruding portion downstream surface 93 is a surface parallel to the protruding portion upstream surface 92 and facing the opposite side in the axial direction Da from the protruding portion upstream surface 92.

The protruding portion inner circumferential surface 94 is a curved surface of the annular protruding portion 9 facing the inner side in the radial direction Dr. The end portion of the protruding portion inner circumferential surface 94 on the downstream side in the axial direction Da is connected to the inner side of the protruding portion downstream surface 93 in the radial direction Dr. The protruding portion inner circumferential surface 94 is formed at a position at a distance from the end surface formed at the tip of the rotor blade 22. A plurality of fins 941 are provided on the protruding portion inner circumferential surface 94. Therefore, the protruding portion inner circumferential surface 94 faces the outer end surface of the rotor blade 22 in the radial direction Dr with a slight gap through the fins 941. As a result, the annular protruding portion 9 also serves as a flow guide that guides the direction in which steam flows.

As shown in FIG. 4, the partition plate 3 that has an annular shape includes an upper half partition plate 31 on the upper portion in the vertical direction Dv and a lower half partition plate 32 on the lower portion with the axis Ar of the rotor 2 as a reference, and a fixing unit 33 that fixes the upper half partition plate 31 and the lower half partition plate 32. The upper half partition plate 31 and the lower half partition plate 32 each have the inner ring 6, the outer ring 7, the nozzle 8, and the annular protruding portion 9.

The cross section of the upper half partition plate 31 orthogonal to the axis Ar forms a semi-annular shape centered on is Ar. The upper half partition plate 31 opens to face the lower side in the vertical direction Dv such that the rotor 2 fits. The upper half partition plate 31 has upper half partition plate dividing surfaces 311 at both ends in the circumferential direction Dc. The upper half partition plate dividing surface 311 is a horizontal surface facing the lower side in the vertical direction Dv.

The lower half partition plate 32 extends in the circumferential direction Dc. The lower half partition plate 32 is fixed to the lower half casing 42 in a state of being accommodated inner side the lower half casing 42. The cross section of the lower half partition plate 32 orthogonal to the axis Ar forms a semi-annular shape centered on the axis Ar. The lower half partition plate 32 opens to face the upper side in the vertical direction Dv such that the rotor 2 fits. The lower half partition plate 32 has lower half partition plate dividing surfaces 321 at both ends in the circumferential direction Dc. The lower half partition plate dividing surface 321 is a horizontal surface facing the upper side in the vertical direction Dv. The upper half partition plate 31 is fixed by the fixing unit 33 in a state of being placed on the lower half partition plate 32 on the upper side in the vertical direction Dv. As a result, the partition plate 3 is formed.

The fixing units 33 are provided at two locations separated from each other in the horizontal direction Dh. Here, the fixing unit 33 provided on one side of the horizontal direction Dh on the right side of the paper surface in FIG. 4 will be described as an example. The fixing unit 33 on the other side of the horizontal direction Dh, for which description is omitted, also has the same configuration.

The fixing unit 33 fixes the upper half partition plate 31 and the lower half partition plate 32 in a state where the upper half partition plate dividing surface 311 and the lower half partition plate dividing surface 321 are in contact with each other. Specifically, the fixing unit 33 fixes the annular protruding portion 9 of the upper half partition plate 31 and the annular protruding portion 9 of the lower half partition plate 32 immovably at a position closer the nozzle 8 than the protruding portion outer circumferential surface 91 in the radial direction Dr. The fixing unit 33 according to the present embodiment includes the bolt 331, a bolt insertion recess 332 formed in the upper half partition plate 31, and a bolt fixing unit 333 formed in the lower half partition plate 32.

The bolt insertion recess 332 is recessed in the vertical direction Dv so as to be toward the upper half partition plate dividing surface 311 from the outer circumferential surface (outer ring outer circumferential surface 73) of the upper half partition plate 31. The bolt insertion recess 332 forms a bolt contact surface 332*a* that is in contact with a head portion of the bolt 331. The bolt contact surface 332*a* is formed at a position separated from the upper half partition plate dividing surface 311 in the vertical direction Dv. The bolt contact surface 332*a* is a plane parallel to the upper half partition plate dividing surface 311. A bolt insertion hole 332*b* in which a screw portion of the bolt 331 can be inserted is formed in the bolt contact surface 332*a*. The bolt insertion hole 332*b* penetrates the upper half partition plate 31 from the bolt contact surface 332*a* to upper half partition plate dividing surface 311.

The bolt fixing unit 333 is a screw hole recessed from the lower half partition plate dividing surface 321. The bolt fixing unit 333 is capable of fixing the bolt 331 by inserting the screw portion of the bolt 331. The bolt fixing unit 333 is provided at a position closer to the outer circumferential surface of the outer shroud ring 83 than the protruding portion outer circumferential surface 91 in the radial direction Dr. The bolt fixing unit 333 is formed such that the position of in the radial direction Dr and the axial direction Da coincides with the bolt insertion hole 332*b*.

As shown in FIG. 2, a plurality of casing positioning recesses 45 recessed over the entire circumference are formed in the inner circumferential surface of the casing 4. The annular protruding portion 9 can be inserted into the casing positioning recess 45. As a result, the casing positioning recess 45 determines the position of the partition plate 3 in the axial direction Da with respect to the casing 4. The casing positioning recess 15 has a recess separation surface 451, a recess bottom surface 452, and a contact support surface 453.

The recess separation surface 451 extends vertically from the inner circumferential surface of the casing 4. The recess separation surface 451 is a plane facing the protruding portion upstream surface 92. The recess separation surface 451 is formed at a position spaced apart from the protruding portion upstream surface 92 in a state where the partition plate 3 is accommodated in the casing 4.

The recess bottom surface 452 is a surface forming a bottom portion of the recess. The recess bottom surface 452 faces the inner side in the radial direction Dr. The recess bottom surface 452 is a surface parallel to the inner circumferential surface of the casing 4. The recess bottom surface 452 extends vertically from the end portion of the recess separation surface 451 on the outer side in the radial direction Dr. The recess bottom surface 452 is a surface facing the protruding portion outer circumferential surface 91. The recess bottom surface 452 is formed at a position spaced apart from the protruding portion outer circumferential surface 91 in a state where the partition plate 3 is accommodated in the casing 4.

The contact support surface 453 extends vertically from the inner circumferential surface of the casing 4. The contact support surface 453 connects the inner circumferential surface of the casing 4 and the end portion of the recess bottom surface 452 on the downstream side in the axial direction Da. In the casing positioning recess 45, the contact support surface 453 faces the recess separation surface 451. The contact support surface 453 is a plane parallel to the recess separation surface 451. The contact support surface 453 faces the protruding portion downstream surface 93. The contact support surface 453 is formed at a position being in contact with the protruding portion downstream surface 93 in a state where the partition plate 3 is accommodated in the casing 4. That is, the contact support surface 453 is in contact with the annular protruding portion 9 from the downstream side in the axial direction Da.

According to the turbine stator 10 described above, the annular protruding portion 9 is formed integrally with the outer ring 7 and protrudes to the downstream side in the axial direction Da from the outer ring 7. As a result, the partition plate 3 has a shape in which the region on the outer side in the radial direction Dr protrudes to the downstream side in the axial direction Da from the region on the inner side in the radial direction Dr where the nozzle 8 or the inner ring 6 is disposed so as to have an arch shape when viewed from the radial direction Dr. Here, in the steam turbine 1, due to the influence of the steam flowing inside, the pressure with respect to the partition plate 3 on the downstream side in the axial direction Da is lower than the pressure on the upstream side. Due to the differential pressure between the upstream side and the downstream side of the partition plate 3, a load is generated on the partition plate 3 such that the region on the inner side in the radial direction Dr is curved toward the downstream side in the axial direction Da. However, in the partition plate 3 according to the present embodiment, the region on the outer side in the radial direction Dr protrudes to the downstream side in the axial direction Da. Further, the partition plate 3 is supported by the casing 4 in a state where the protruding portion downstream surface 93 is in contact with the contact support surface 453. As a result, a compressive force acts on the region of the partition plate 3 on the inner side in the radial direction Dr. Even in a case where a load is generated by the differential pressure between the upstream side and the downstream side of the partition plate 3, the compressive force resists the load, so that in the partition plate 3, deformation such that the region on the inner side in the radial direction Dr is directed to the downstream side in the axial direction Da is suppressed. As a result, the rigidity of the partition plate 3 with respect to the differential pressure can be ensured without increasing the thickness of the region on the inner side in the radial direction Dr. Therefore, it is possible to suppress the deformation of the partition plate 3 while reducing the thickness of the partition plate 3 in the axial direction Da.

Also, the annular protruding portion 9 protrudes to the outer side of the outer ring 7 in the radial direction Dr in addition to the axial direction Da. Therefore, in a case where the upper half casing 41 is assembled to the partition plate 3 accommodated in the lower half casing 42, the annular protruding portion 9 first contacts with the upper half casing 41 in the partition plate 3, and becomes a guide with respect to the upper half casing 41. As a result, the position of the annular protruding portion 9 with respect to the casing 4 can be determined with high accuracy. Accordingly, the annular protruding portion 9 can be reliably brought into contact with the contact support surface 453, and the deformation of the partition plate 3 can be suppressed with higher accuracy.

Further, the tapered surface 921 is formed on the corner formed by the protruding portion upstream surface 92 and the protruding portion outer circumferential surface 91. Therefore, in a case where the upper half casing 41 is assembled to the partition plate 3, it is possible to prevent the inner circumferential surface of the casing 4 from being placed on the corner and making it difficult for the annular protruding portion 9 to be inserted into the casing positioning recess 45. Therefore, the annular protruding portion 9 can be smoothly inserted into the casing positioning recess 45. As a result, it is possible to suppress the assemblability from being deteriorated such that the partition plate 3 and the casing 4 do not fit.

Further, the annular protruding portion 9 also protrudes to the inner side of the outer ring 7 in the radial direction Dr. Further, the fins 941 that are sliding contact with the tip of the rotor blade 22 are provided on the protruding portion inner circumferential surface 94. Therefore, the annular protruding portion 9 itself can serve as a flow guide.

Also, since the partition plate 3 has the vertically divided structure, it is possible to improve the assemblability of the partition plate 3. On the other hand, in a case where a load is generated on the partition plate 3 due to the vertically divided structure, the upper half partition plate 31 and the lower half partition plate 32 are easily deformed so as to be open between the upper half partition plate dividing surface 311 and the lower half partition plate dividing surface 321. However, the bolt fixing unit 333 is formed at a position closer to the outer circumferential surface of the outer shroud ring 83 than the protruding portion outer circumferential surface 91 in the radial direction Dr. Therefore, the upper half partition plate 31 and the lower half partition plate 32 are fixed at positions close to the nozzle 8. As a result, in a case where a load is generated on the partition plate 3, it is possible to make it difficult to open the region on the inner side in the radial direction Dr, which is particularly easy to open, of the upper half partition plate dividing surface 311 and the lower half partition plate dividing surface 321. Accordingly, the amount of deformation of the partition plate 3 can be suppressed.

Further, by using the partition plate 3 having the annular protruding portion 9, the thickness of the partition plate 3 is reduced. Therefore, the casing 4 can be made smaller than the ease where the partition plate 3 having no annular protruding portion 9 is used. In particular, in the present embodiment, the position of the annular protruding portion 9 in the axial direction Da overlaps the position of the rotor blade 22. Therefore, the annular protruding portion 9 is formed by utilizing the space located on the outer side of the rotor blade 22 in the radial direction Dr. As a result, in the partition plate 3, the thickness of the region on the inner side in the radial direction Dr (the region adjacent to the motor blade 22 in the axial direction Da) where the nozzle 8 or the inner ring 6 is formed can be prevented from increasing. As a result, the steam turbine 1 as a whole can be made compact. Further, even in a case where the number of stages is increased to improve efficiency of the steam turbine 1, the increase in size of the steam turbine 1 as a whole can be prevented.

Modification Example Other than Embodiment

Although the embodiments of the present invention have been described in detail with reference to the drawings, the configurations and combinations thereof in the respective embodiments are examples, and the configurations are added, omitted, replaced, and changed within a range not deviating from the gist of the present invention. Further, the present invention is not limited to the embodiment, but only to the scope of claims.

For example, the annular protruding portion 9 is not limited to being formed integrally with the outer ring 7. The annular protruding portion 9 need only have a structure in which the protruding portion downstream surface 93 is in contact with the casing 4 while protruding to the downstream side in the axial direction Da from the outer ring 7. Therefore, the annular protruding portion 9 may be joined to the outer ring 7 by welding or the like after being formed by a member different from the outer ring 7.

Further, the annular protruding portion 9 is not limited to have a structure in which the fins 941 are provided on the protruding portion inner circumferential surface 94. For example, the annular protruding portion 9 has a structure that does not protrude to the inner side in the radial direction Dr from the outer ring 7, and a flow guide provided with the fins separately from the annular protruding portion 9 may be disposed between the annular protruding portion 9 and the rotor blade 22 in the radial direction Dr.

Also, the fixing unit 33 is not limited to have a structure of immovably fixing the annular protruding portion 9 of the upper half partition plate 31 and the annular protruding portion 9 of the lower half partition plate 32 at a position closer to the nozzle 8 than the protruding portion outer circumferential surface 91 in the radial direction Dr. For example, in the case of the structure in which the annular protruding portion 9 does not protrude to the outer side of the outer ring 7 in the radial direction Dr, the fixing unit 33 may fix the upper half partition plate 31 and the lower half partition plate 32 at a position closer to the nozzle 8 than the outer circumferential surface of the outer ring 7 in the radial direction Dr. Further, the fixing unit 33 is not limited to have a structure of fixing the annular protruding portion 9 of the upper half partition plate 31 and the annular protruding portion 9 of the lower half partition plate 32. The fixing unit 33 may fix the outer ring 7 of the upper half partition plate 31 and the outer ring 7 of the lower half partition plate.

INDUSTRIAL APPLICABILITY

According to the present invention, it is possible to suppress deformation while reducing the thickness in the axial direction.

REFERENCE SIGNS LIST

1 steam turbine
2 rotor
21 rotor shaft
22 rotor blade
Ar axis
Da axial direction
Dr radial direction
Dv vertical direction
Dh horizontal direction
Dc circumferential direction
10 turbine stator
3 partition plate
6 inner ring
61 inner ring outer circumferential surface
62 inner ring nozzle fixing groove
63 inner ring inner circumferential surface
64 seal support groove
65 labyrinth seal
7 outer
71 outer ring inner circumferential surface
72 outer ring nozzle fixing groove
73 outer ring outer circumferential surface
8 nozzle
81 inner shroud ring
811 inner protrusion
82 blade
83 outer shroud ring
831 outer protrusion
50 welding portion
9 annular protruding portion
91 protruding portion outer circumferential surface
92 protruding portion upstream surface
921 tapered surface
93 protruding portion downstream surface
94 protruding portion inner circumferential surface
941 fin
31 upper half partition plate
311 upper half partition plate dividing surface
32 lower half partition plate
321 lower half partition plate dividing surface
33 fixing unit
331 bolt
332 bolt insertion recess
332*a* bolt contact surface
332*b* bolt insertion hole
333 bolt fixing unit
4 casing
41 upper half casing
42 lower half casing
45 casing positioning recess
451 recess separation surface
452 recess bottom surface
453 contact support surface

The invention claimed is:

1. A turbine stator comprising:
a partition plate comprising:
an inner ring that extends along a circumferential direction around an axis;
an outer ring that:
is disposed on an outer side with respect to the inner ring in a radial direction with respect to the axis, and
extends in the circumferential direction;
nozzles that:
are disposed between the inner ring and the outer ring in the circumferential direction and aligned with the outer ring in an axial direction in which the axis extends, and
are configured to guide a fluid from an upstream side toward a downstream side in the axial direction; and
an annular protruding portion that:
protrudes from the outer ring only to the downstream side in the axial direction and does not overlap the nozzles in the axial direction, and
extends along the outer ring in the circumferential direction; and
a casing:

surrounding the partition plate from the outer side in the radial direction, and having a contact support surface that is in contact with the annular protruding portion from the downstream side in the axial direction, wherein the partition plate comprises:

an upper half partition plate having:

a semi-annular shape, and upper half partition plate dividing surfaces that are horizontal surfaces facing a lower side in a vertical direction at both ends in the circumferential direction;

a lower half partition plate having:

a semi-annular shape, and lower half partition plate dividing surfaces that are configured to contact with the upper half partition plate dividing surfaces at both ends in the circumferential direction; and a fixing unit that comprises:

a bolt insertion hole in the annular protruding portion of the upper half partition plate, the bolt insertion hole penetrating through the annular protruding portion of the upper half partition plate;

a screw hole in the annular protruding portion of the lower half partition plate, the screw hole being recessed from the lower half partition plate dividing surface; and a bolt that comprises a screw portion that is inserted in the bolt insertion hole and that is fixed in the screw hole, the annular protruding portion comprises:

a protruding portion outer circumferential surface that is disposed on the outer side in the radial direction from an outer circumferential surface of the outer ring and that faces the outer side in the radial direction;

a protruding portion upstream surface that is disposed on the outer side in the radial direction from the outer circumferential surface of the outer ring and that faces the upstream side in the axial direction;

a tapered surface disposed at a corner that is disposed by the protruding portion outer circumferential surface and the protruding portion upstream surface;

a protruding portion downstream surface that is connected to an end portion of the protruding portion outer circumferential surface on the downstream side in the axial direction and that faces the downstream side in the axial direction; and a protruding portion inner circumferential surface that is connected to an end portion of the protruding portion downstream surface in the radial direction and that faces an inner side in the radial direction, and the fixing unit fixes the annular protruding portion of the upper half partition plate and the annular protruding portion of the lower half partition plate immovably at a position closer to the nozzles in the radial direction than at least one of the outer circumferential surface of the outer ring and an outer circumferential surface of the annular protruding portion is.

2. The turbine stator according to claim 1, wherein the annular protruding portion protrudes to the outer side in the radial direction from the outer circumferential surface of the outer ring facing the outer side in the radial direction.

3. The turbine stator according to claim 1, wherein a fin is disposed on a surface of the annular protruding portion which faces the inner side in the radial direction.

4. A steam turbine comprising:

the turbine stator according to claim 1; and a rotor that is configured to rotate around the axis in the turbine stator.

5. A partition plate comprising:

an upper half partition plate having:

a semi-annular shape, and upper half partition plate dividing surfaces that are horizontal surfaces facing a lower side in a vertical direction at both ends in a circumferential direction around an axis; and a lower half partition plate having:

a semi-annular shape, and lower half partition plate dividing surfaces that are configured to contact with the upper half partition plate dividing surfaces at both ends in the circumferential direction, wherein each of the upper half partition plate and the lower half partition plate comprises:

an inner ring that extends along the circumferential direction;

an outer ring that:

is disposed on an outer side with respect to the inner ring in a radial direction with respect to the axis, and extends in the circumferential direction;

nozzles that:

are disposed between the inner ring and the outer ring in the circumferential direction and aligned with the outer ring in an axial direction in which the axis extends, and are configured to guide a fluid from an upstream side toward a downstream side in the axial direction; and an annular protruding portion that:

protrudes from the outer ring only to the downstream side in the axial direction and does not overlap the nozzles in the axial direction, and extends along the outer ring in the circumferential direction, the annular protruding portion protrudes to the outer side in the radial direction from an outer circumferential surface of the outer ring facing the outer side in the radial direction, the partition plate further comprises a fixing unit that comprises:

a bolt insertion hole in the annular protruding portion of the upper half partition plate, the bolt insertion hole penetrating through the annular protruding portion of the upper half partition plate;

a screw hole in the annular protruding portion of the lower half partition plate, the screw hole being recessed from the lower half partition plate dividing surface; and a bolt that comprises a screw portion that is inserted in the bolt insertion hole and that is fixed in the screw hole, the annular protruding portion comprises:

a protruding portion outer circumferential surface that is disposed on the outer side in the radial direction from an outer circumferential surface of the outer ring and that faces the outer side in the radial direction;

a protruding portion upstream surface that is disposed on the outer side in the radial direction from the outer circumferential surface of the outer ring and that faces the upstream side in the axial direction;

a tapered surface disposed at a corner that is disposed by the protruding portion outer circumferential surface and the protruding portion upstream surface;

a protruding portion downstream surface that is connected to an end portion of the protruding portion outer circumferential surface on the downstream side in the axial direction and that faces the downstream side in the axial direction; and a protruding portion inner circumferential surface that is connected to an end portion of the protruding portion downstream surface in the radial direction and that faces an inner side in the radial direction, and the fixing unit fixes the annular protruding portion of the upper half partition plate and the annular protruding portion of the lower half partition plate immovably at a position closer to the nozzles in the radial direction than at least one of the outer circumferential surface of the outer ring and an outer circumferential surface of the annular protruding portion is.

* * * * *